US006727663B2

(12) United States Patent
Buij et al.

(10) Patent No.: US 6,727,663 B2
(45) Date of Patent: Apr. 27, 2004

(54) CIRCUIT ARRANGEMENT FOR FEEDING A LOAD

(75) Inventors: Arnold Willem Buij, Eindhoven (NL); Antonius Henricus Peterus Johannes Habraken, Eindhoven (NL); Geert Willem Van der Veen, Eindhoven (NL); Everaard Marie Jozef Aendekerk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/227,204

(22) Filed: Aug. 23, 2002

(65) Prior Publication Data

US 2003/0039131 A1 Feb. 27, 2003

(30) Foreign Application Priority Data

Aug. 27, 2001 (EP) ..... 01203231

(51) Int. Cl.[7] ..... H05B 37/02

(52) U.S. Cl. ..... 315/224; 315/291; 315/209 R; 315/307

(58) Field of Search ..... 315/209 R, 224, 315/225, 246, 291, 307, DIG. 2, DIG. 5, DIG. 7

(56) References Cited

U.S. PATENT DOCUMENTS

| | | | | | |
|---|---|---|---|---|---|
| 3,434,053 | A | | 3/1969 | McKee | 324/132 |
| 5,075,602 | A | * | 12/1991 | Overgoor et al. | 315/307 |
| 5,450,268 | A | | 9/1995 | Phillips et al. | 361/93 |
| 5,670,849 | A | * | 9/1997 | Melai | 315/307 |
| 6,078,147 | A | * | 6/2000 | Arts et al. | 315/291 |
| 6,376,997 | B1 | * | 4/2002 | Aendekerk | 315/291 |
| 6,522,089 | B1 | * | 2/2003 | Duong et al. | 315/308 |
| 6,545,432 | B2 | * | 4/2003 | Konopka | 315/291 |

FOREIGN PATENT DOCUMENTS

| | | | |
|---|---|---|---|
| EP | 0605052 A1 | 6/1994 | H05B/41/29 |

* cited by examiner

*Primary Examiner*—Don Wong
*Assistant Examiner*—Tuyet T. Vo

(57) ABSTRACT

An electronic ballast for supplying a lamp comprises a control loop for controlling the rms value of an operational parameter so as to be constant. In the control loop, the actual rms value of the parameter is generated as a linear combination of its average value and its peak value.

4 Claims, 2 Drawing Sheets

CIRCUIT ARRANGEMENT FOR FEEDING A LOAD

BACKGROUND OF THE INVENTION

The invention relates to a circuit arrangement for feeding a load, which is equipped with

- input terminals which are to be connected to a supply voltage source,
- a power converter for generating a current through the load from a supply voltage supplied by the supply voltage source,
- a control circuit for controlling the root-mean-square (rms) value of an operating parameter, comprising
- a first circuit for generating a first signal that is a measure of the actual rms value of the operating parameter,
- a second circuit for generating a second signal that is a measure of the desired rms value of the operating parameter,
- a third circuit that is coupled to the first and the second circuit for generating a third signal that is dependent on the first and the second signal, and for influencing the operating state of the circuit arrangement in dependence on the third signal.

Such a circuit arrangement is known. The first signal is frequently generated by successively rectifying and averaging the signal that represents the operating parameter. As regards sinusoidal signals, it applies that Vrms=1.111 * Vavg, where Vrms is the rms value of the signal and Vavg is the average value, so that said operation yields a reliable rms value for sinusoidal signals. However, if said operation is applied to a signal that deviates substantially from a sine-shaped signal, the result of the operation may also deviate substantially from the actual rms value of the signal. To determine the rms value of such a non-sinusoidal signal use can be made of a "true rms sensor". Such a "true rms sensor" however is a complicated circuit comprising many (active) components, as a result of which said circuit is also comparatively expensive.

SUMMARY OF THE INVENTION

It is an object of the invention to provide a circuit arrangement wherein the rms value of an operating parameter can be determined by means of comparatively simple means and regulated so as to obtain a desired level.

To achieve this, a circuit arrangement as mentioned in the opening paragraph is characterized in accordance with the invention in that the first circuit is equipped with

- a fourth circuit for generating a fourth signal that is a measure of the actual average value of the operating parameter,
- a fifth circuit for generating a fifth signal that is a measure of the actual maximum amplitude of the operating parameter,
- a sixth circuit for generating a signal that is a linear combination of the third signal and the fourth signal.

It has been found that the rms value generated by the first circuit of a circuit arrangement in accordance with the invention is substantially equal to the actual rms value of the operating parameter, even if the form of the operating parameter as a function of time deviates substantially from the sine shape. By virtue thereof, also the rms value of the operating parameter is accurately regulated so as to obtain the desired value. The fourth circuit and the fifth circuit can be obtained using comparatively simple electronics, so that these circuits are also comparatively inexpensive. The same applies to the sixth circuit.

Good results were achieved using embodiments of a circuit arrangement in accordance with the invention wherein the load is a lamp, and the operating parameter is selected among the group consisting of the lamp current, the lamp voltage and the power consumed by the lamp.

Good results were also achieved using embodiments of a circuit arrangement in accordance with the invention wherein the sixth circuit generates a signal of the general formula $$A*OPavg+B*OPmax,$$

wherein OPavg and OPmax are the value of the fourth signal and the value of the fifth signal, respectively, and wherein $$0<A<1$$

and $$0<B<1.$$

More particularly, good results were achieved for embodiments wherein $$0.76<A<0.93$$

and $$0.12<B<0.19.$$

These and other aspects of the invention are apparent from and will be elucidated with reference to the embodiment(s) described hereinafter.

DESCRIPTION OF THE PREFERRED EMBODIMENT(S)

Figure 1:
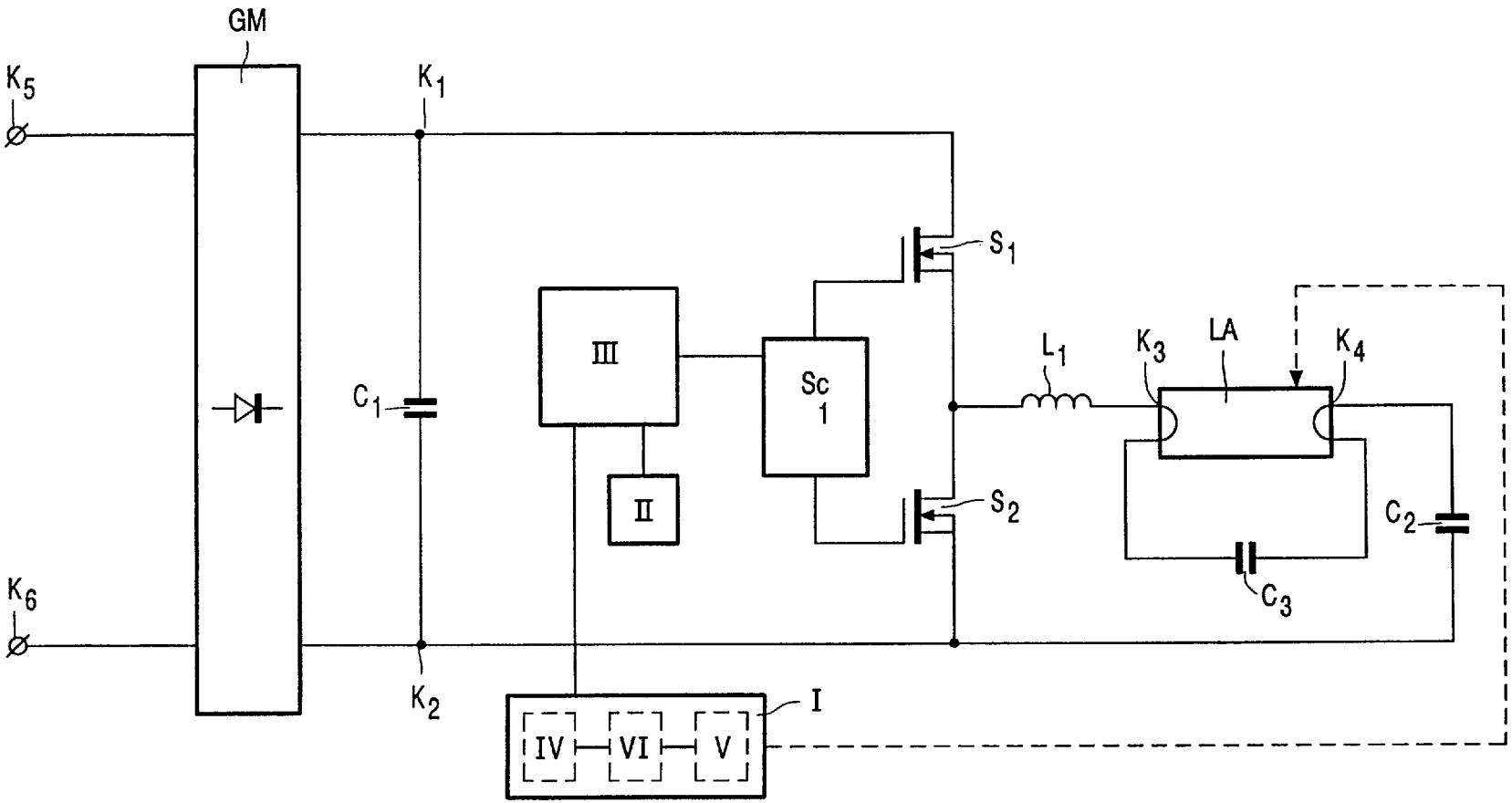
FIG. 1 shows an example of a circuit arrangement in accordance with the invention to which a lamp is connected.

In FIG. 1, K5 and K6 are input terminals that are to be connected to the poles of a supply voltage source. Input terminals K5 and K6 are connected to respective inputs of the circuit part GM that forms a rectifier in the form of a diode bridge. A first output K1 of circuit part GM is connected to a second output K2 by means of a capacitor C1 and by means of a series arrangement of switching element S1 and switching element S2. A control electrode of switching element S1 is connected to a first output of circuit part Sc1. A control electrode of switching element S2 is connected to a second output of circuit part Sc1. Circuit part Sc1 is a control circuit for generating a control signal for rendering the switching elements S1 and S2 alternately conducting and non-conducting at a frequency f. Switching element S2 is shunted by a series arrangement of coil L1, lamp terminal K3, lamp LA, lamp terminal K4 and capacitor C2. The lamp LA is shunted by capacitor C3. Circuit parts GM and Sc1, switching elements S1 and S2, coil L1, lamp terminals K3 and K4 and capacitors C2 and C3 jointly form a power converter for generating a current from a supply voltage supplied by the supply voltage source, which current flows through the load formed by the lamp LA. An input of circuit part Sc1 is coupled to an output of circuit part III. A first input of circuit part III is connected to an output of circuit part II. A further input of circuit part III is connected to an output of circuit part I. An input of circuit part I is coupled to the lamp LA. In FIG. 1, this coupling is indicated by means of a dashed line. Circuit part I forms a first circuit for generating a first signal that is a measure of the rms value of an operating parameter which, in this example, is a lamp quantity. Circuit part I comprises circuit parts IV, V and VI which are coupled with each other. Circuit part IV forms a fourth circuit for generating a fourth signal that is a measure of the actual average value of the operating parameter. Circuit part V forms a fifth circuit for generating a fifth signal that is a measure of the actual maximum amplitude of the operating parameter. Circuit part VI forms a sixth circuit for generating a signal that is a linear combination of the third signal and the fourth signal. For this reason, respective inputs of circuit part VI are coupled to an output of circuit part IV and an output of circuit part V. Circuit part II forms a second circuit for generating a second signal that is a measure of the desired rms value of the operating parameter. Circuit part III forms a third circuit for generating a third signal that depends on the first signal and the second signal, and for influencing the operating state of the circuit arrangement in dependence upon the third signal. Circuit part I, II and III jointly form a control circuit for controlling the rms value of the operating parameter.

Next, a description is given of the operation of the circuit arrangement shown in FIG. 1.

If the input terminals K5 and K6 are connected to a supply voltage source such as the electric power mains supplying a low-frequency AC voltage, this low-frequency AC voltage is rectified by the circuit part GM and a substantially constant DC voltage is present across capacitor C1. The circuit part Sc1 renders the switching elements S1 and S2 alternately conducting and non-conducting at a frequency f. As a result, a substantially square-wave voltage of frequency f is present at a junction point of the two switching elements, and an alternating current of frequency f flows through the lamp. The circuit part I generates the first signal that is a measure of the rms value of a lamp quantity such as the lamp current, lamp voltage or lamp power. The first signal is formed via the circuit part VI as a linear combination of the fourth signal generated by circuit part IV and the fifth signal generated by circuit part V. More particularly, the first signal is equal to 0.845*OPavg+0.155*OPpk, where OPavg and OPpk form, respectively, the fourth signal and the fifth signal. The circuit part II generates a second signal that is a measure of the desired rms value of the lamp quantity. The circuit part III generates a third signal from the first and the second signal. This third signal is used to influence the operating state of the circuit arrangement via the frequency and/or the duty cycle of the control signal in such a manner that the rms value of the lamp quantity at any moment in time is substantially equal to the desired value. This can be achieved, for example, via the frequency and/or duty cycle of the control signal. It is also possible to regulate the conduction time of the switching elements or the voltage across capacitor C1 by means of means that are not shown in FIG. 1.

Figure 2A:
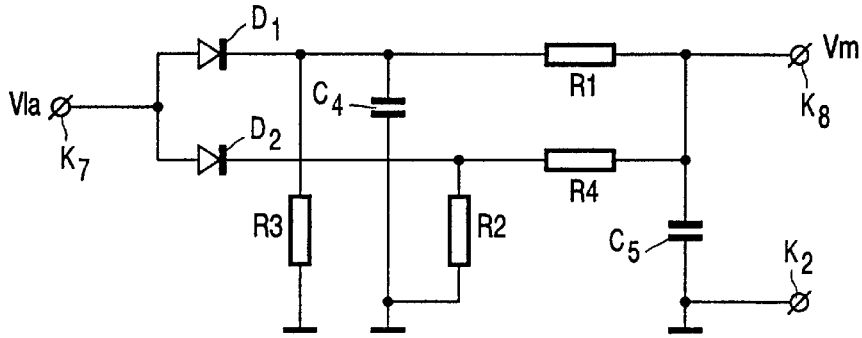
FIG. 2 shows different embodiments of a part of the circuit arrangement shown in FIG. 1.

FIG. 2A shows an embodiment of the circuit part I of the circuit arrangement shown in FIG. 1 wherein the lamp quantity forming the operating parameter is the lamp voltage. K2 and K7 are terminals between which a signal is present during operation of the circuit arrangement shown in FIG. 1, which signal is a measure of the actual value of the lamp voltage. This can be achieved, for example, by arranging the primary winding of a transformer equipped with a primary winding and a secondary winding over the lamp and connecting the terminals K2 and K7 to respective ends of the secondary winding. Terminals K7 and K2 are interconnected by means of a series arrangement of diode D1, ohmic resistor R1 and capacitor C5. The series arrangement of diode D1 and ohmic resistor R1 is shunted by a series arrangement of diode D2 and ohmic resistor R4. A junction point of diode D1 and ohmic resistor R1 is connected to terminal K2 by means of ohmic resistor R3. Ohmic resistor R3 is shunted by capacitor C4. A junction point of diode D2 and ohmic resistor R4 is connected to terminal K2 by means of ohmic resistor R2. A junction point of ohmic resistor R1, ohmic resistor R4 and capacitor C5 forms terminal K8. During operation of the circuit arrangement shown in FIG. 1, the first signal is present between terminal K8 and terminal K2. Diode D2, ohmic resistors R2 and R4, and capacitor C5 jointly form the circuit part IV. Diode D1, capacitors C4 and C5 and ohmic resistors R3 and R1 jointly form the circuit part V. The circuit VI is formed by the junction point of ohmic resistor R1, ohmic resistor R4 and capacitor C5.

Next, a description is given of the operation of the example shown in FIG. 2A.

If a signal that is a measure of the actual lamp voltage is present between the terminals K7 and K2, then the circuit part IV generates a fourth signal that is a measure of the actual average value of the lamp voltage. Circuit part V generates a signal that is a measure of the actual maximum value of the amplitude of the lamp voltage. Circuit part VI generates the first signal that is a linear combination of the first and the second signal: A*OPavg+B*OPpk, where OPavg forms the fourth signal and OPpk forms the fifth signal. The values of the constants A and B are determined by the resistance values of the ohmic resistors R1, R2, R3 and R4. The first signal is formed by the voltage across capacitor C5.

Figure 2B:
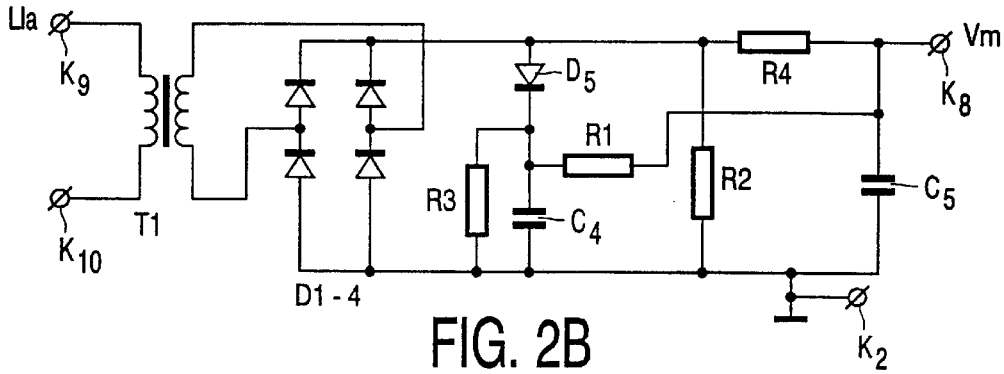

FIG. 2B shows an example of circuit part I, wherein the operating parameter whose rms value is controlled is the lamp current. K9 and K10 are terminals forming the ends of the primary winding of a transformer T1. During operation of the circuit arrangement shown in FIG. 1, a signal that is a measure of the actual value of the lamp current is present between the terminals K9 and K10. This can be achieved, for example, by arranging the transformer and the lamp so as to be in series. Respective ends of a secondary winding of the transformer T1 are connected to respective inputs of a diode bridge formed by diodes D1–D4. A first output of the diode bridge is connected to a second output by means of ohmic resistor R2 and by means of a series arrangement of diode D5 and capacitor C4. Capacitor C4 is shunted by ohmic resistor R3 and by a series arrangement of ohmic resistor R1 and capacitor C5. Ohmic resistor R2 is shunted by a series arrangement of ohmic resistor R4 and capacitor C5. A junction point of ohmic resistor R4 and capacitor C5 forms a terminal K8. During operation of the circuit arrangement, the first signal is present between terminal K8 and terminal K2 in the form of the voltage across capacitor C5. Circuit part IV is formed by transformer T1, the diode bridge, ohmic resistors R4 and R2 and capacitor C5. Circuit part V is formed by transformer T1, the diode bridge, diode D5, ohmic resistors R3 and R1 and capacitors C4 and C5. Circuit part VI is formed by the junction point of ohmic resistor R1, ohmic resistor R4 and capacitor C5.

The operation of the example shown in FIG. 2 corresponds to the operation of the example shown in FIG. 2A and will not be separately described herein. Also in this example, the values of the constants A and B are determined by the resistance values of the ohmic resistors R1, R2, R3 and R4.

Figure 2C:
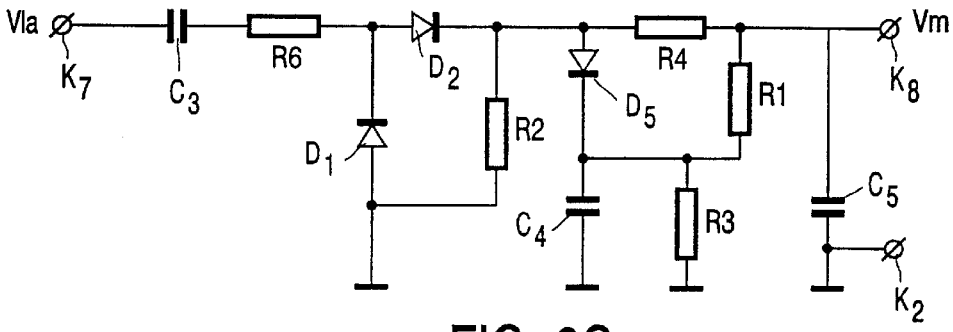

FIG. 2C shows a further embodiment of the circuit part I, in which the operating parameter whose rms value is controlled is the lamp voltage. K2 and K7 are terminals between which, during operation of the circuit arrangement shown in FIG. 1, a signal is present that is a measure of the actual value of the lamp voltage. This can be achieved, for example, by arranging the primary winding of a transformer equipped with a primary and a secondary winding over the lamp and connecting terminals K2 and K7 to respective ends of the secondary winding. Terminals K7 and K2 are connected together by means of a series arrangement of capacitor C3, ohmic resistor R6 and diode D1. Diode D1 is shunted by a series arrangement of diode D2 and ohmic resistor R2. A junction point of diode D2 and ohmic resistor R2 is connected to terminal K2 by means of a series arrangement of diode D5 and capacitor C4. Diode D5 is shunted by a series arrangement of ohmic resistor R4 and ohmic resistor R1. Capacitor C4 is shunted by ohmic resistor R3. A junction point of ohmic resistor R4 and ohmic resistor R1 forms a terminal K8. Terminal K8 is connected to terminal K2 by means of a capacitor C5. During operation of the circuit arrangement, the first signal is present between terminals K8 and K2 in the form of the voltage across capacitor C5. Capacitor C3, ohmic resistors R6 and R2, and diodes D1 and D2 form a single-phase rectifier that, during operation, rectifies the signal present between terminals K7 and K2. This rectifier and ohmic resistors R4, R1 and R3, and capacitor C5 jointly form the circuit part IV. The circuit part V is formed by the rectifier in combination with diode D5, capacitors C4 and C5 and ohmic resistors R1 and R3. Circuit part VI is formed by the junction point of ohmic resistor R4, ohmic resistor R1 and capacitor C5.

The operation of the example shown in FIG. 2C corresponds to the operation of the examples shown in FIG. 2A and FIG. 2B and will not be separately described herein. Also in this example, the values of the constants A and B are determined by the resistance values of the ohmic resistors R1, R2, R3 and R4.

Figure 2D:
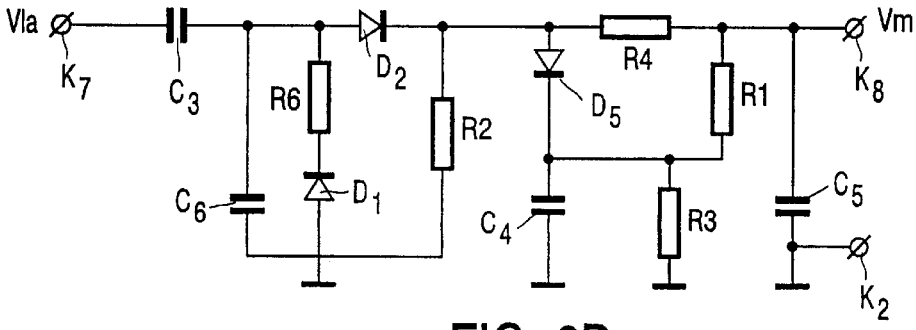

FIG. 2D forms a fourth example of circuit part I, which corresponds substantially to the example shown in FIG. 2C. In the example shown in FIG. 2D, ohmic resistor R6 is arranged in series with diode D1. The series arrangement of diode D1 and ohmic resistor R6 is shunted by a capacitor C6. For the rest, the structure of the example shown in FIG. 2D corresponds to that of the example shown in FIG. 2C. Capacitor C4 and capacitor C3 jointly form a capacitive divider. The resistance value of ohmic resistor R6 is chosen to be substantially equal to that of ohmic resistor R2. As a result, diode D1 and diode D2 carry substantially equal currents and a DC offset due to a difference in diode threshold voltages does not develop.

The operation of the example shown in FIG. 2D corresponds to the operation of the examples shown in FIG. 2A, FIG. 2B and FIG. 2C and will not be separately described herein.

What is claimed is:

1. A circuit arrangement for feeding a load, which is equipped with input terminals for connection to a supply voltage source, a power converter for generating a current through the load from a supply voltage supplied by the supply voltage source, a control circuit for controlling the rms value of an operating parameter to achieve a desired rms value comprising a first circuit for generating a first signal that is a measure of the rms value of the operating parameter, a second circuit for generating a second signal that is a measure of the desired rms value of the operating parameter, a third circuit that is coupled to the first and the second circuit for generating a third signal that is dependent on the first and the second signal, and for influencing the operating state of the circuit arrangement in dependence on the third signal, characterized in that the first circuit is equipped with a fourth circuit for generating a fourth signal that is a measure of the average value of the operating parameter, a fifth circuit for generating a fifth signal that is a measure of the maximum amplitude of the operating parameter, a sixth circuit for generating a signal that is a linear combination of the third signal and the fourth signal.

2. The circuit arrangement as claimed in claim 1, wherein the load is a lamp, and the operating parameter is selected among the group consisting of the lamp current and the lamp voltage.

3. The circuit arrangement as claimed in claim 1, wherein the sixth circuit generates a signal of the general formula $$A*OPavg+B*OPmax,$$

wherein OPavg and OPmax are the value of the fourth signal and the value of the fifth signal, respectively, and wherein $$0<A<1$$

and $$0<B<1.$$

4. The circuit arrangement as claimed in claim 3, wherein $$0.76<A<0.93$$

and $$0.12<B<0.19.$$

* * * * *